US010665164B2

(12) United States Patent
Yamazaki et al.

(10) Patent No.: US 10,665,164 B2
(45) Date of Patent: May 26, 2020

(54) DISPLAY DRIVER AND SEMICONDUCTOR DEVICE

(71) Applicant: LAPIS Semiconductor Co., Ltd., Yokohama (JP)

(72) Inventors: Koji Yamazaki, Yokohama (JP); Atsushi Hirama, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 106 days.

(21) Appl. No.: 15/618,430

(22) Filed: Jun. 9, 2017

(65) Prior Publication Data

US 2017/0358277 A1 Dec. 14, 2017

(30) Foreign Application Priority Data

Jun. 10, 2016 (JP) ..... 2016-116043

(51) Int. Cl.

| | |
|---|---|
| ***G09G 3/3258*** | (2016.01) |
| ***G09G 3/34*** | (2006.01) |
| ***G09G 5/02*** | (2006.01) |
| ***G09G 5/10*** | (2006.01) |
| ***G09G 3/3266*** | (2016.01) |
| ***G09G 3/3275*** | (2016.01) |
| ***G09G 3/36*** | (2006.01) |

(52) U.S. Cl.

CPC ..... *G09G 3/3258* (2013.01); *G09G 3/3266* (2013.01); *G09G 3/3275* (2013.01); *G09G 3/3413* (2013.01); *G09G 3/3426* (2013.01); *G09G 3/3677* (2013.01); *G09G 3/3688* (2013.01); *G09G 5/02* (2013.01); *G09G 5/10* (2013.01); *G09G 2310/027* (2013.01); *G09G 2310/0235* (2013.01); *G09G 2320/0242* (2013.01); *G09G 2320/0276* (2013.01); *G09G 2320/0626* (2013.01); *G09G 2320/0673* (2013.01); *G09G 2360/16* (2013.01)

(58) Field of Classification Search

CPC .. G09G 3/3258; G09G 3/3275; G09G 3/3688; G09G 3/3677; G09G 3/3413; G09G 3/3266; G09G 3/3426; G09G 5/10; G09G 5/02; G09G 2320/0242; G09G 2320/0626; G09G 2310/027; G09G 2310/0235; G09G 2320/0276; G09G 2320/0673; G09G 2360/16

See application file for complete search history.

(56) References Cited

U.S. PATENT DOCUMENTS 7,969,398 B2 * 6/2011 Shirasaki ..... G09G 3/3233 345/210
8,605,079 B2 * 12/2013 Morita ..... G09G 3/3688 345/213

(Continued)

FOREIGN PATENT DOCUMENTS

JP 2012-137783 A 7/2012

*Primary Examiner* — Grant Sitta
(74) *Attorney, Agent, or Firm* — Rabin & Berdo, P.C.

(57) ABSTRACT

A display driver includes a gamma correction data transmission unit that transmits a plurality of gamma correction data pieces one by one in each predetermined period. A brightness level indicated by a video signal is converted into a gradation voltage with a gamma characteristic based on the gamma correction data piece transmitted from the gamma correction data transmission unit.

8 Claims, 7 Drawing Sheets

(56) References Cited

U.S. PATENT DOCUMENTS

| | | | | |
|---|---|---|---|---|
| 8,723,763 | B2 * | 5/2014 | Jeong | G09G 3/3233 345/82 |
| 8,836,733 | B2 * | 9/2014 | Lee | G09G 5/10 345/690 |
| 9,183,785 | B2 * | 11/2015 | Kim | G09G 3/3233 |
| 9,265,125 | B2 * | 2/2016 | Kim | H05B 37/02 |
| 9,721,503 | B2 * | 8/2017 | Kato | G09G 3/3233 |
| 2001/0033260 | A1 * | 10/2001 | Nishitani | G09G 3/3406 345/87 |
| 2009/0189924 | A1 * | 7/2009 | Ogura | G09G 3/3233 345/690 |
| 2014/0333648 | A1 * | 11/2014 | Ouchi | G09G 5/02 345/589 |
| 2015/0201123 | A1 * | 7/2015 | Koguchi | H04N 5/23212 348/239 |
| 2015/0242701 | A1 * | 8/2015 | Tokui | H04N 5/243 382/190 |
| 2016/0323555 | A1 * | 11/2016 | Suzuki | G06T 3/40 |
| 2018/0130417 | A1 * | 5/2018 | Yamazaki | G09G 3/3688 |

* cited by examiner

DISPLAY DRIVER AND SEMICONDUCTOR DEVICE

BACKGROUND OF THE INVENTION

1. Field of the Invention

The present invention relates to a display driver for driving a display panel and a semiconductor device in which the display driver is provided.

2. Description of the Related Art

Display drivers for driving a display panel such as a liquid crystal display panel and an organic EL display panel generate gradation voltages corresponding to brightness levels of respective errors indicated by input video signals, and apply the gradation voltages to respective source lines of the display panels as pixel drive voltages. The display drivers perform gamma correction to correct the correspondence relation between brightness indicated by the input video signal and brightness actually displayed on the display panel, in each of red, green, and blue colors.

As such a display driver that performs the gamma correction, there is proposed one that includes three systems of gradation voltage conversion circuits. The three systems of gradation voltage conversion circuits include three systems of registers to store set values for the gamma correction on a color-by-color (red, green, and blue) basis, and convert display data into gradation voltages on a color-by-color (red, green, and blue) basis in accordance with characteristics based on the set values stored in the registers (for example, see Patent Document 1: Japanese Patent Application Laid-Open No. 2012-137783).

SUMMARY OF THE INVENTION

By the way, the gradation voltage conversion circuit includes, in addition to the aforementioned registers, a ladder resistor to generate a reference gradation voltage corresponding to each gradation in accordance with the set value stored in the register, and an amplifier to output the voltage.

Accordingly, the display driver needs to have the three systems of gradation voltage conversion circuits (including the registers, the ladder resistors, and the amplifiers) corresponding to respective colors, thus causing an increase in the area of the gradation voltage conversion circuit in a chip and hence an increase in the size of the display driver.

Therefore, an object of the present invention is to provide a display driver that can be reduced in size, and a semiconductor device in which the display driver is formed.

According to one aspect of the present invention, a display driver supplies a display device having a plurality of display cells with gradation voltages corresponding to the brightness levels of the respective display cells indicated by a video signal. The display driver includes a gamma correction data transmission unit for transmitting a plurality of gamma correction data pieces representing gamma correction values one by one in each predetermined period, and a gradation voltage conversion unit for converting the brightness levels into the gradation voltages with a gamma characteristic based on the gamma correction value indicated by the gamma correction data piece transmitted from the gamma correction data transmission unit.

According to another aspect of the present invention, a semiconductor device includes a display driver that is formed therein and supplies a display device having a plurality of display cells with gradation voltages corresponding to the brightness levels of the respective display cells indicated by a video signal. The display driver includes a gamma correction data transmission unit for transmitting a plurality of gamma correction data pieces representing gamma correction values one by one in each predetermined period, and a gradation voltage conversion unit for converting the brightness levels into the gradation voltages with a gamma characteristic based on the gamma correction value indicated by the gamma correction data piece transmitted from the gamma correction data transmission unit.

According to one aspect of the present invention, the display driver is provided with the gamma correction data transmission unit that transmits the plurality of gamma correction data pieces one by one in each predetermined period. The gradation voltage conversion unit converts the brightness levels indicated by the video signal into the gradation voltages with the gamma characteristic based on the gamma correction data piece transmitted from the gamma correction data transmission unit.

According to such a configuration, the display driver just has only one system of gradation voltage conversion unit, irrespective of the number of types of gamma characteristics. Therefore, it is possible to reduce the size of the circuit, as compared with a configuration in which, for example, three systems of gradation voltage conversion units for each of three types of gamma characteristics corresponding to red, green, and blue colors are provided to convert brightness levels into gradation voltages with the gamma characteristics.

DETAILED DESCRIPTION OF THE INVENTION

Embodiments of the present invention will be described below in detail with reference to the drawings.

Figure 1:
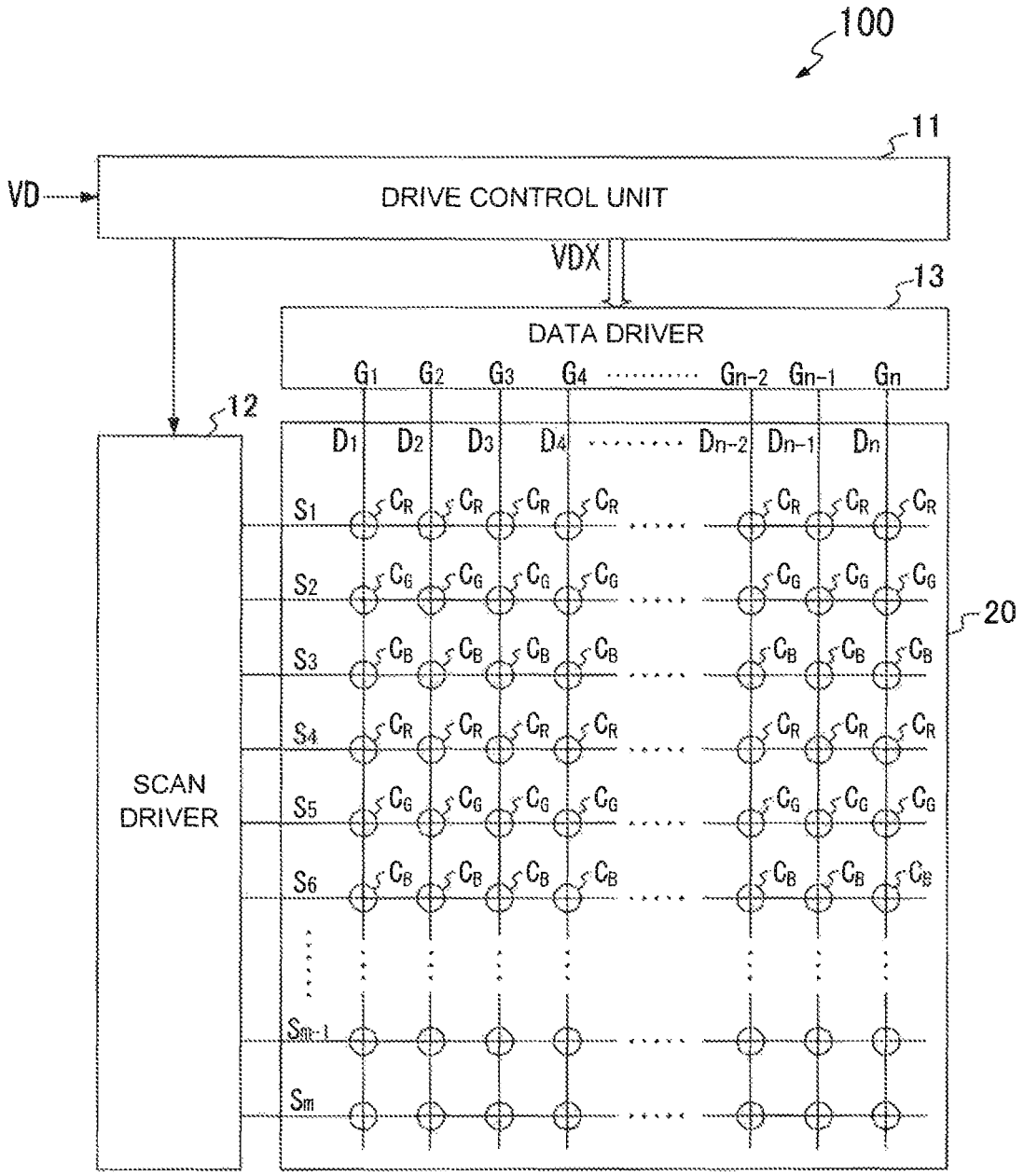
FIG. 1 is a block diagram showing a schematic configuration of a display apparatus 100 including a display driver according to the present invention.

FIG. 1 is a block diagram showing the schematic configuration of a display apparatus 100 including a display driver according to the present invention. In FIG. 1, a display device 20 is constituted by, for example, a liquid crystal display panel, and includes m (m is a natural number of 2 or more) horizontal display lines $S_1$ to $S_m$ extending in a horizontal direction of a two-dimensional screen and n (n is an even number of 2 or more) data lines $D_1$ to $D_n$ extending in a vertical direction of the two-dimensional screen. At each of intersections between each horizontal display line and each data line, a display cell $C_R$ for red display, a display cell $C_G$ for green display, or a display cell $C_B$ for blue display is formed.

In the display device 20, as shown in FIG. 1, the display cell $C_R$ is formed at each of the intersections between the horizontal display line $S_1$ and the data lines $D_1$ to $D_n$. The display cell $C_G$ is formed at each of the intersections between the horizontal display line $S_2$ and the data lines $D_1$ to $D_n$. The display cell $C_B$ is formed at each of the intersections between the horizontal display line $S_3$ and the data lines $D_1$ to $D_n$. The display cell $C_R$ is formed at each of the intersections between the horizontal display line $S_4$ and the data lines $D_1$ to $D_n$. The display cell $C_G$ is formed at each of the intersections between the horizontal display line $S_5$ and the data lines $D_1$ to $D_n$. The display cell $C_B$ is formed at each of the intersections between the horizontal display line $S_6$ and the data lines $D_1$ to $D_n$.

In other words, the horizontal display lines $S_{(3r-2)}$ (r is natural numbers) are red display lines in each of which n display cells $C_R$ for red display are arranged. The horizontal display lines $S_{(3r-1)}$ are green display lines in each of which n display cells $C_G$ for green display are arranged. The horizontal display lines $S_{(3r)}$ are blue display lines in each of which n display cells $C_B$ for blue display are arranged.

Figure 2:
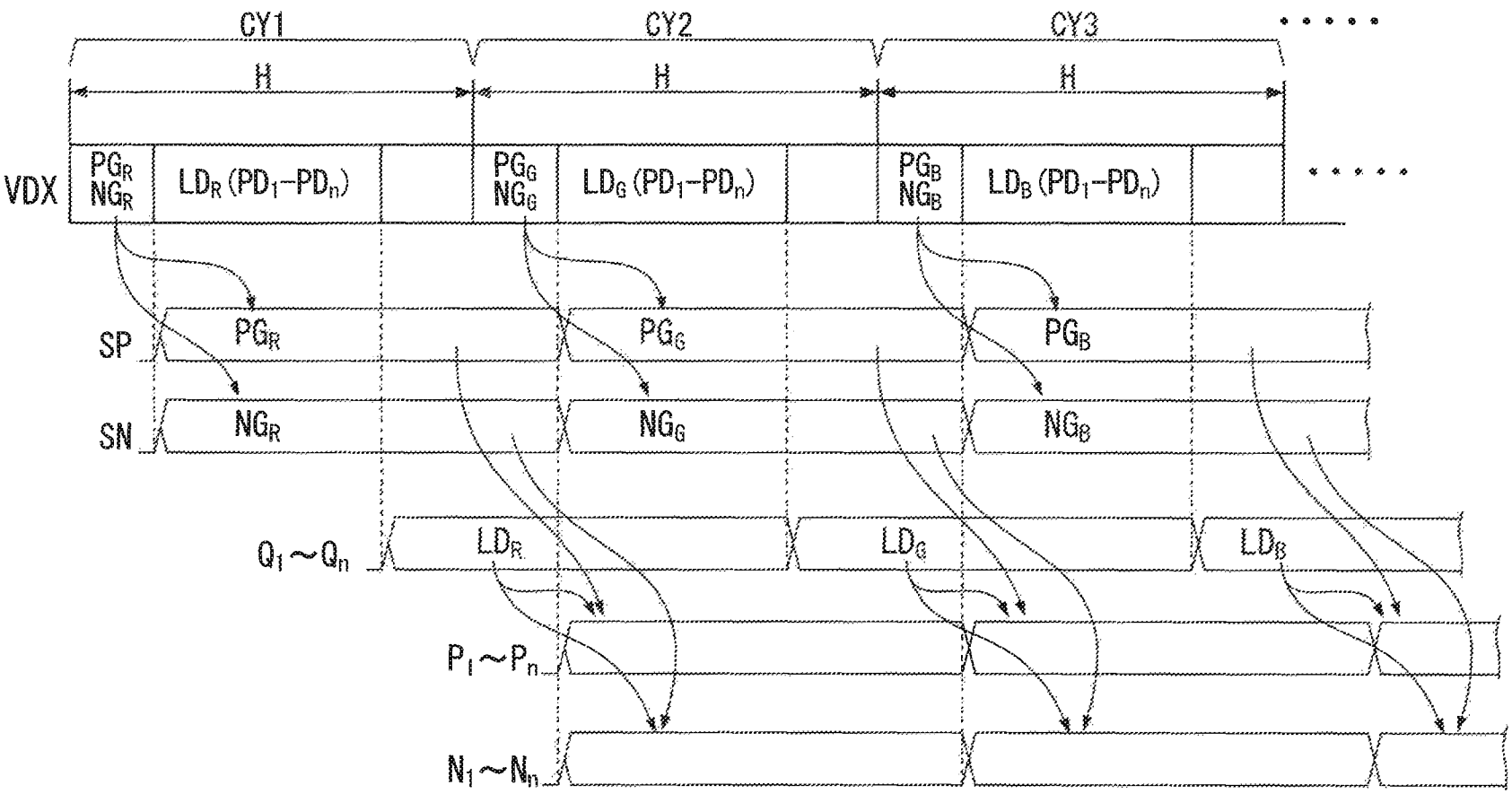
FIG. 2 is a time chart showing an example of the format of an image data signal VDX and an example of the internal operation of a gradation voltage conversion unit 132.

A drive control unit 11 generates an image data signal VDX in a format of FIG. 2 based on a video signal VD.

In other words, the drive control unit 11 first calculates display data PD that represents a brightness level of each display cell ($C_R$, $C_G$, $C_B$) as, for example a 256-step brightness gradation of 8 bits, on the basis of the video signal VD. Next, the drive control unit 11 groups 3·n pieces of display data PD corresponding to three horizontal display lines of every three horizontal display lines S adjoining to each other on a color-by-color basis. In other words, the drive control unit 11 groups the 3·n pieces of display data PD into a display data series $LD_R$ including the display data $PD_1$ to $PD_n$ corresponding to the red display cells $C_R$, a display data series $LD_G$ including the display data $PD_1$ to $PD_n$ corresponding to the green display cells $C_G$, and a display data series $LD_B$ including the display data $PD_1$ to $PD_n$ corresponding to the blue display cells $C_B$.

The drive control unit 11, as shown in FIG. 2, generates the image data signal VDX in which the display data series $LD_R$ corresponding to red are arranged in (3r-2)th horizontal scan periods H, the display data series $LD_G$ corresponding to green are arranged in (3r-1)th horizontal scan periods H, and the display data series $LD_B$ corresponding to blue are arranged in (3r)th horizontal scan periods H. Furthermore, the drive control unit 11 arranges γ-correction data, which is used when displaying each display data series ($LD_R$, $LD_G$, $LD_B$), for each horizontal scan period H of the image data signal VDX.

In other words, as shown in FIG. 2, positive γ-correction data $PG_R$ and negative γ-correction data $NG_R$ each representing γ-correction values for a red component are arranged in the horizontal scan period H having the display data series $LD_R$ in the image data signal VDX. Positive γ-correction data $PG_G$ and negative γ-correction data $NG_G$ each representing γ-correction values for a green component are arranged in the horizontal scan period H having the display data series $LD_G$ in the image data signal VDX. Positive γ-correction data $PG_B$ and negative γ-correction data $NG_B$ each representing γ-correction values for a blue component are arranged in the horizontal scan period H having the display data series $LD_B$ in the image data signal VDX. The γγ-correction data ($PG_R$, $NG_R$, $PG_G$, $NG_G$, $PG_B$, $NG_B$) represents information corresponding to γ-correction values that are used when converting the display data PD into gradation voltages. To be more specific, the γ-correction data represents information for designating, out of nodes (called output taps below) between resistors in ladder resistors (described later), a plurality of output taps, for example, five output taps to perform a conversion corresponding to the γ-correction values.

The drive control unit 11 supplies the image data signal VDX generated as described above to a data driver 13. Furthermore, whenever the drive control unit 11 detects a horizontal synchronization signal from the video signal VD, the drive control unit 11 supplies a horizontal synchronization detection signal to a scan driver 12.

The scan driver 12 sequentially applies scan pulses to each of the horizontal display lines $S_1$ to $S_m$ of the display device 20 in synchronous timing with the horizontal synchronization detection signal.

The data driver 13 is formed in a semiconductor IC (integrated circuit) chip.

Figure 3:
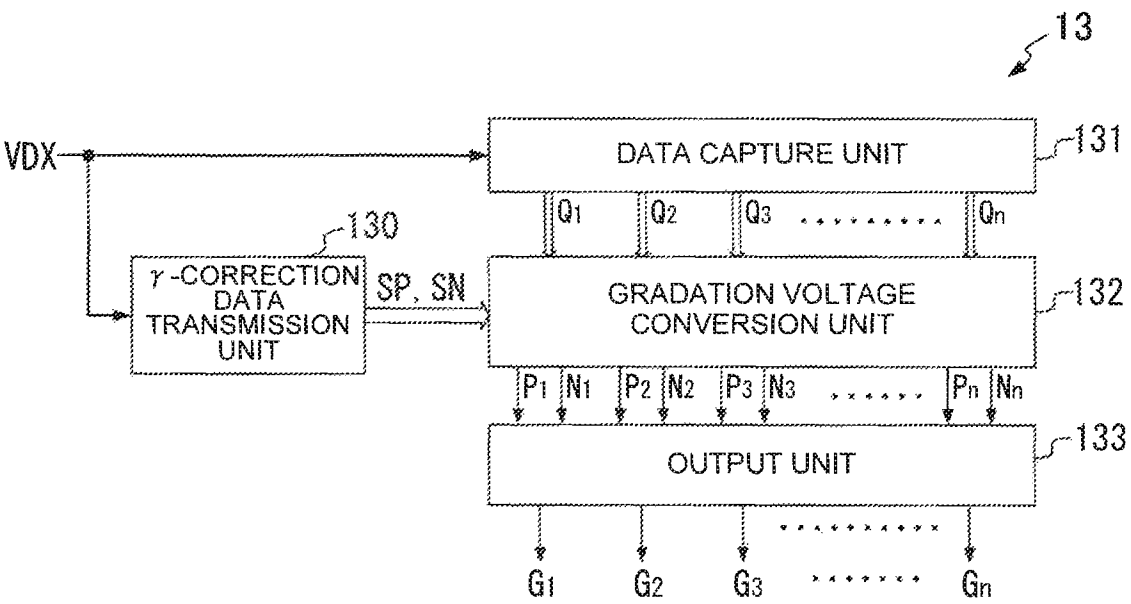
FIG. 3 is a block diagram showing the internal configuration of a data driver 13.

FIG. 3 is a block diagram showing the internal configuration of the data driver 13. As shown in FIG. 3, the data driver 13 has a γ-correction data transmission unit 130, a data capture unit 131, a gradation voltage conversion unit 132, and an output unit 133.

The γ-correction data transmission unit 130 extracts the positive γ-correction data $PG_R$, $PG_G$, or $PG_B$ from the image data signal VDX, and supplies the extracted positive γ-correction data to the gradation voltage conversion unit 132 as γ-correction data SP. The γ-correction data transmission unit 130 also extracts the negative γ-correction data $NG_R$, $NG_G$, or $NG_B$ from the image data signal VDX, and supplies the extracted negative γ-correction data to the gradation voltage conversion unit 132 as γ-correction data SN.

The data capture unit 131 sequentially captures the display data $PD_1$ to $PD_n$ constituting the display data series ($LD_R$, $LD_G$, $LD_B$) from the image data signal VDX for each horizontal scan period H, and supplies the n pieces of display data $PD_1$ to $PD_n$ to the gradation voltage conversion unit 132 as display data $Q_1$ to $Q_n$.

The gradation voltage conversion unit 132 converts the display data $Q_1$ to $Q_n$ into analog positive gradation voltages $P_1$ to $P_n$, respectively, with a conversion characteristic based on the positive γ-correction data ($PG_R$, $PG_G$, $PG_B$) included in the image data signal VDX. Furthermore, the gradation voltage conversion unit 132 converts the display data $Q_1$ to $Q_n$ into analog negative gradation voltages $N_1$ to $N_n$, respectively, with a conversion characteristic based on the negative γ-correction data ($NG_R$, $NG_G$, $NG_B$) included in the image data signal VDX. The gradation voltage conversion unit 132 supplies the gradation voltages $P_1$ to $P_n$ and $N_1$ to $N_n$ to the output unit 133.

The output unit 133 selects one of each of the positive gradation voltages $P_1$ to $P_n$ and each of the negative gradation voltages $N_1$ to $N_n$ in an alternate manner at established intervals, and supplies the selected gradation voltages to the data lines $D_1$ to $D_n$ of the display device 20 as gradation voltages $G_1$ to $G_n$.

Figure 4:
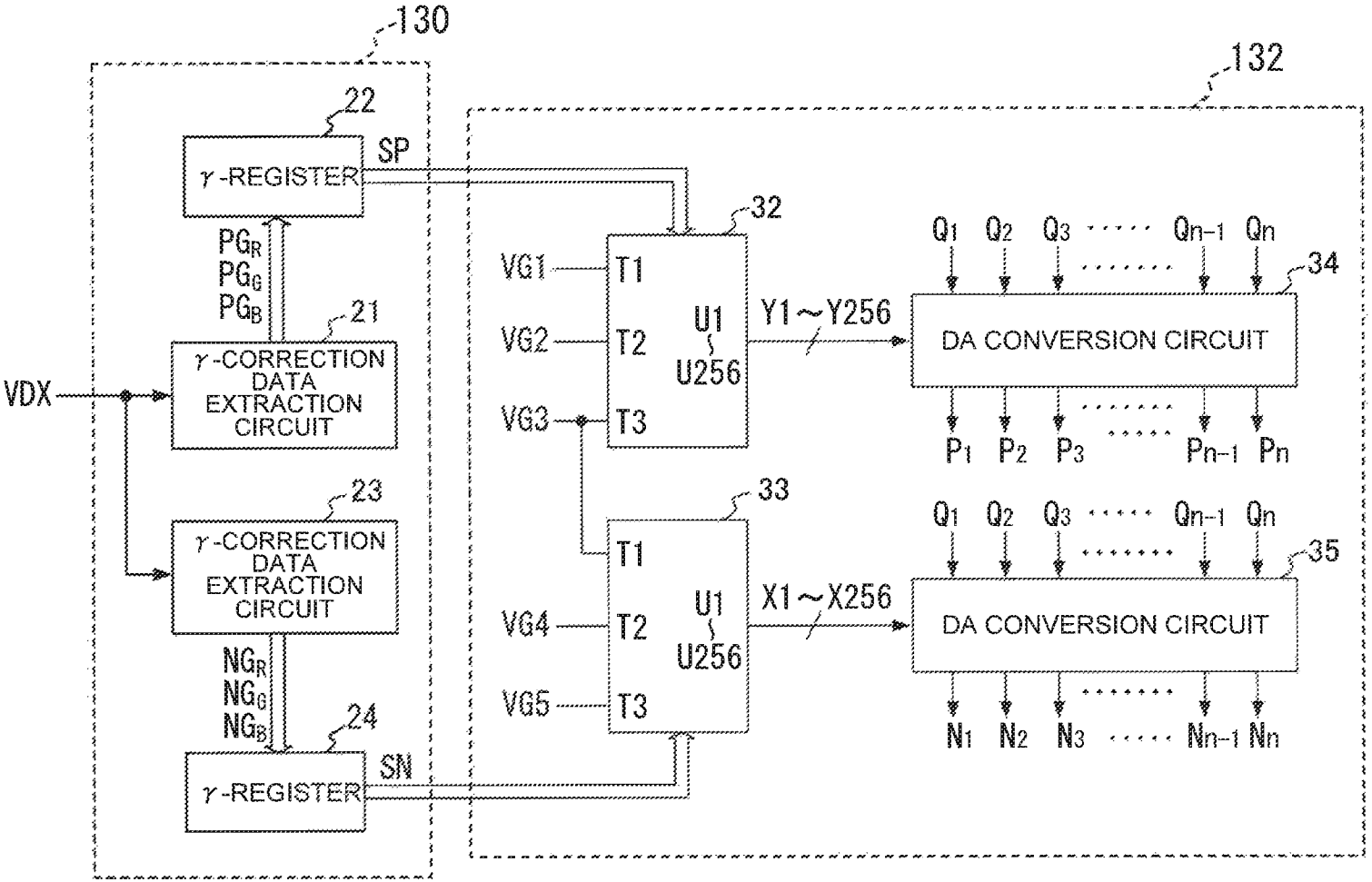
FIG. 4 is a block diagram showing the internal configuration of a γ-correction data transmission unit 130 and the gradation voltage conversion unit 132.

FIG. 4 is a block diagram showing an example of the internal configuration of the γ-correction data transmission unit 130 and the gradation voltage conversion unit 132. As shown in FIG. 4, the γ-correction data transmission unit 130 includes a γ-correction data extraction circuit 21, a γ register 22, a γ-correction data extraction circuit 23, and a γ register 24.

The γ-correction data extraction circuit 21 extracts positive γ-correction data $PG_R$, $PG_G$, or $PG_B$ from an image data signal VDX, and supplies the extracted positive γ-correction data $PG_R$, $PG_G$, or $PG_B$ to the γ register 22 in each horizontal scan period H. The γ register 22 writes over previous data and holds the positive γ-correction data $PG_R$, $PG_G$, or $PG_B$ supplied by the γ-correction data extraction circuit 21. The γ register 22 transmits the one piece of γ-correction data, which is held as described above, of the γ-correction data $PG_R$, $PG_G$, and $PG_B$ to the gradation voltage conversion unit 132 over the one horizontal scan period H as positive γ-correction data SP.

The γ-correction data extraction circuit 23 extracts negative γ-correction data $NG_R$, $NG_G$, or $NG_B$ from the image data signal VDX, and supplies the extracted negative γ-correction data $NG_R$, $NG_G$, or $NG_B$ to the γ register 24 in each horizontal scan period H. The γ register 24 writes over previous data and holds the negative γ-correction data $NG_R$, $NG_G$, or $NG_B$ supplied by the γ-correction data extraction circuit 23. The γ register 24 transmits the one piece of γ-correction data, which is held as described above, of the γ-correction data $NG_R$, $NG_G$, and $NG_B$ to the gradation voltage conversion unit 132 over the one horizontal scan period H as negative γ-correction data SN.

According to the configuration as described above, the γ-correction data transmission unit 130 transmits the γ-correction data pieces $PG_R$, $PG_G$, and $PG_B$ to the gradation voltage conversion unit 132 one by one for each horizontal scan period H. The γ-correction data transmission unit 130 also transmits the γ-correction data pieces $NG_R$, $NG_G$, and $NG_B$ to the gradation voltage conversion unit 132 one by one for each horizontal scan period H.

The gradation voltage conversion unit 132 includes reference gradation voltage generation circuits 32 and 33, and DA conversion circuits 34 and 35.

Each of the reference gradation voltage generation circuits 32 and 33 has voltage setting terminals T1 to T3 and output terminals U1 to U256 to output reference gradation voltages of 256 steps.

The reference gradation voltage generation circuit 32 is supplied with set voltages VG1 to VG3, which have the following magnitude relations of voltage values, through the voltage setting terminals T1 to T3 of itself.

$$VG1>VG2>VG3$$

The reference gradation voltage generation circuit 32 generates 256-step positive reference gradation voltages Y1 to Y256 having difference voltage values to each other on the basis of the set voltages VG1 to VG3, and supplies the positive reference gradation voltages Y1 to Y256 to the DA conversion circuit 34.

The reference gradation voltage generation circuit 33 is supplied with set voltages VG3 to VG5, which have the following magnitude relations of voltage values, through the voltage setting terminals T1 to T3 of itself.

$$VG3>VG4>VG5$$

The reference gradation voltage generation circuit 33 generates 256-step negative reference gradation voltages X1 to X256 having difference voltage values to each other on the basis of the set voltages VG3 to VG5, and supplies the negative reference gradation voltages X1 to X256 to the DA conversion circuit 35.

The DA conversion circuit 34 selects a reference gradation voltage that corresponds to a brightness gradation represented by display data Q of each piece of the display data $Q_1$ to $Q_n$ supplied by the data capture unit 131, from the positive reference gradation voltages Y1 to Y256. The DA conversion circuit 34 outputs each of the gradation voltages Y, which are selected for each piece of the display data $Q_1$ to $Q_n$ as described above, as positive gradation voltages $P_1$ to $P_n$.

The DA conversion circuit 35 selects a reference gradation voltage that corresponds to a brightness gradation represented by display data Q of each piece of the display data $Q_1$ to $Q_n$ supplied by the data capture unit 131, from the negative reference gradation voltages X1 to X256. The DA conversion circuit 35 outputs each of the gradation voltages X, which are selected for each piece of the display data $Q_1$ to $Q_n$ as described above, as negative gradation voltages $N_1$ to $N_n$.

Figure 5:
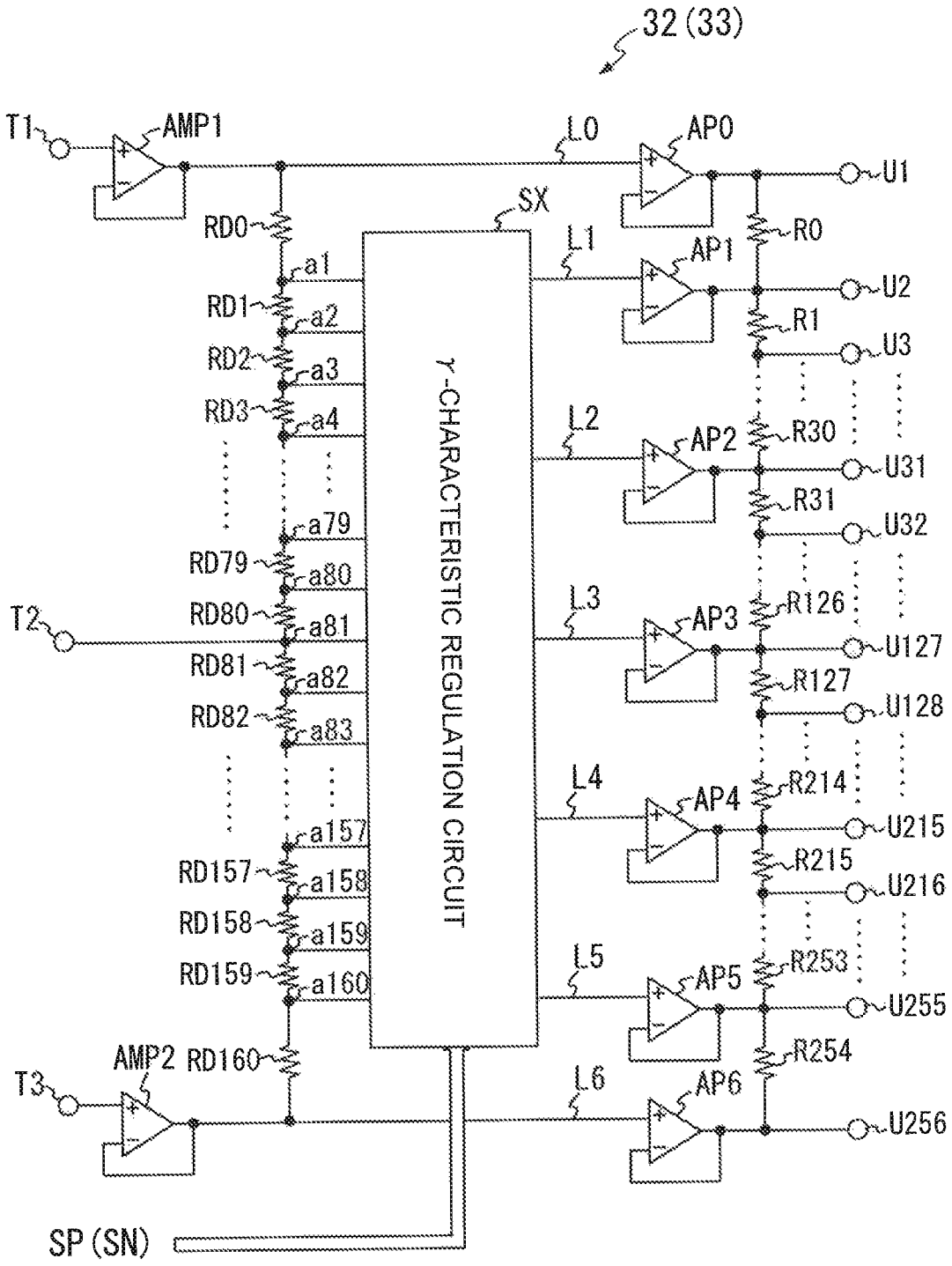
FIG. 5 is a circuit diagram showing an example of the internal configuration of a reference gradation voltage generation circuit 32 (33)

FIG. 5 is a circuit diagram showing the internal configuration of each of the reference gradation voltage generation circuits 32 and 33. Note that, the reference gradation voltage generation circuits 32 and 33 have the same circuit configuration. Each of the reference gradation voltage generation circuits 32 and 33 includes input amplifiers AMP1 and AMP2, a first ladder resistor (RD0 to RD160), a γ characteristic regulation circuit SX, output amplifiers AP0 to AP6, and a second ladder resistor (R0 to R254).

The first ladder resistor has resistors RD0 to RD160 connected in series. Output taps a1 to a160, which are nodes of the resistors RD0 to RD160, are connected to the γ characteristic regulation circuit SX. Note that, to the midpoint output tap a81 of the output taps a1 to a160, the voltage setting terminal T2 is connected.

The input amplifier AMP1 amplifies a voltage received at the voltage setting terminal T1 with a gain of 1, and supplies the amplified voltage through a line L0 to one end of the first resistor RD0 of the first ladder resistor and the output amplifier AP0. The input amplifier AMP2 amplifies a voltage received at the voltage setting terminal T3 with a gain of 1, and supplies the amplified voltage through a line L6 to one end of the last resistor RD160 of the first ladder resistor and the output amplifier AP6.

The γ characteristic regulation circuit SX connects five output taps that correspond to a γ-correction value represented by γ-correction data SP (SN) supplied by the γ-correction data transmission unit 130, in other words, five output taps of the output taps a1 to a160 of the first ladder resistor to lines L1 to L5, respectively. Note that, the line L1 is connected to an input terminal of the output amplifier AP1, and the line L2 is connected to an input terminal of the output amplifier AP2. The line L3 is connected to an input terminal of the output amplifier AP3, the line L4 is connected to an input terminal of the output amplifier AP4, and the line L5 is connected to an input terminal of the output amplifier AP5. For example, the γ characteristic regulation circuit SX connects, out of the five output taps that correspond to the γ-correction value represented by the γ-correction data SP (SN), the first output tap to the line L1, the second output tap to the line L2, and the third output tap to the line L3. Moreover, the γ characteristic regulation circuit SX connects the fourth output tap of the five output taps that correspond to the γ-correction value represented by the γ-correction data to the line L4, and connects the fifth output tap to the line L5.

The second ladder resistor has resistors R0 to R254 connected in series. The output terminal U1 is connected to one end of the first resistor R0 of the resistors R0 to R254, and the output terminal U256 is connected to one end of the last resistor R254. Furthermore, as shown in FIG. 5, the output terminals U2 to U255 are connected to nodes of the resistors R0 to R254 connected in series, respectively.

The output amplifier AP0 amplifies a voltage of the line L0 with a gain of 1, and supplies the amplified voltage to one end of the resistor R0 and the output terminal U1. The output amplifier AP1 amplifies a voltage of the line L1 with a gain of 1, and supplies the amplified voltage to the node between the resistors R0 and R1 and the output terminal U2. The output amplifier AP2 amplifies a voltage of the line L2 with a gain of 1, and supplies the amplified voltage to the node between the resistors R30 and R31 and the output terminal U31. The output amplifier AP3 amplifies a voltage of the line L3 with a gain of 1, and supplies the amplified voltage to the node between the resistors R126 and R127 and the output terminal U127. The output amplifier AP4 amplifies a voltage of the line L4 with a gain of 1, and supplies the amplified voltage to the node between the resistors R214 and R215 and the output terminal U215. The output amplifier AP5 amplifies a voltage of the line L5 with a gain of 1, and supplies the amplified voltage to the node between the resistors R253 and R254 and the output terminal U255. The output amplifier AP6 amplifies a voltage of the line L6 with a gain of 1, and supplies the amplified voltage to one end of the resistor R254 and the output terminal U256.

According to the configuration of FIG. 5, the reference gradation voltage generation circuit 32 (33) generates the reference gradation voltages Y1 to Y256 (X1 to X256) having a γ characteristic based on the γ-correction data SP (SN) supplied by the γ-correction data transmission unit 130, and supplies the reference gradation voltages Y1 to Y256 (X1 to X256) to the DA conversion circuit 34 (35) through the output terminals U1 to U256.

The operation of the configuration shown in FIGS. 4 and 5 will be described below with reference to FIG. 2.

First, in a horizontal scan period CY1 of an image data signal VDX in which a display data series $LD_R$ is arranged, as shown in FIG. 2, the γ-correction data extraction circuit 21 of the γ-correction data transmission unit 130 extracts positive γ-correction data $PG_R$ arranged in the head portion thereof from the image data signal VDX, and supplies the positive γ-correction data $PG_R$ to the γ register 22. In the horizontal scan period CY1, the γ-correction data extraction circuit 23 of the γ-correction data transmission unit 130 extracts negative γ-correction data $NG_R$ arranged in the head portion thereof from the image data signal VDX, and supplies the negative γ-correction data $NG_R$ to the γ register 24. Thus, as shown in FIG. 2, the γ register 22 supplies the γ-correction data $PG_R$ to the γ characteristic regulation circuit SX of the reference gradation voltage generation circuit 32 as γ-correction data SP, while holding the γ-correction data $PG_R$. Also, as shown in FIG. 2, the γ register 24 supplies the γ-correction data $NG_R$ to the γ characteristic regulation circuit SX of the reference gradation voltage generation circuit 33 as γ-correction data SN, while holding the γ-correction data $NG_R$.

Thus, the reference gradation voltage generation circuit 32 generates reference gradation voltages Y1 to Y256 having a γ characteristic based on the γ-correction data $PG_R$, and supplies the reference gradation voltages Y1 to Y256 to the DA conversion circuit 34. The reference gradation voltage generation circuit 33 generates reference gradation voltages X1 to X256 having a γ characteristic based on the γ-correction data $NG_R$, and supplies the reference gradation voltages X1 to X256 to the DA conversion circuit 35. The DA conversion circuit 34 converts display data $Q_1$ to $Q_n$ corresponding to the aforementioned display data series $LD_R$ into analog positive gradation voltages $P_1$ to $P_n$, respectively, on the basis of the reference gradation voltages Y1 to Y256 having the γ characteristic based on the γ-correction data $PG_R$. The DA conversion circuit 35 converts display data $Q_1$ to $Q_n$ corresponding to the aforementioned display data series $LD_R$ into analog negative gradation voltages $N_1$ to $N_n$, respectively, on the basis of the reference gradation voltages X1 to X256 having the γ characteristic based on the γ-correction data $NG_R$.

Next, in a horizontal scan period CY2 of the image data signal VDX in which a display data series $LD_G$ is arranged, as shown in FIG. 2, the γ-correction data extraction circuit 21 extracts positive γ-correction data $PG_G$ arranged in the head portion thereof from the image data signal VDX, and supplies the positive γ-correction data $PG_G$ to the γ register 22. In the horizontal scan period CY2, the γ-correction data extraction circuit 23 extracts negative γ-correction data $NG_G$ arranged in the head portion thereof from the image data signal VDX, and supplies the negative γ-correction data $NG_G$ to the γ register 24. Thus, as shown in FIG. 2, the γ register 22 supplies the γ-correction data $PG_G$ to the γ characteristic regulation circuit SX of the reference gradation voltage generation circuit 32 as γ-correction data SP, while writing over the previous data and holding the γ-correction data $PG_R$. Also, as shown in FIG. 2, the γ register 24 supplies the γ-correction data $NG_G$ to the γ characteristic regulation circuit SX of the reference gradation voltage generation circuit 33 as γ-correction data SN, while writing over the previous data and holding the γ-correction data $NG_G$.

Thus, the reference gradation voltage generation circuit 32 generates reference gradation voltages Y1 to Y256 having a γ characteristic based on the γ-correction data $PG_G$, and supplies the reference gradation voltages Y1 to Y256 to the DA conversion circuit 34. The reference gradation voltage generation circuit 33 generates reference gradation voltages X1 to X256 having a γ characteristic based on the γ-correction data $NG_G$, and supplies the reference gradation voltages X1 to X256 to the DA conversion circuit 35. The DA conversion circuit 34 converts display data $Q_1$ to $Q_n$ corresponding to the aforementioned display data series $LD_G$ into analog positive gradation voltages $P_1$ to $P_n$, respectively, on the basis of the reference gradation voltages Y1 to Y256 having the γ characteristic based on the γ-correction data $PG_G$. The DA conversion circuit 35 converts display data $Q_1$ to $Q_n$ corresponding to the aforementioned display data series $LD_G$ into analog negative gradation voltages $N_1$ to $N_n$, respectively, on the basis of the reference gradation voltages X1 to X256 having the γ characteristic based on the γ-correction data $NG_G$.

Next, in a horizontal scan period CY3 of the image data signal VDX in which a display data series $LD_B$ is arranged, as shown in FIG. 2, the γ-correction data extraction circuit 21 extracts positive γ-correction data $PG_B$ arranged in the head portion thereof from the image data signal VDX, and supplies the positive γ-correction data $PG_B$ to the γ register 22. In the horizontal scan period CY3, the γ-correction data extraction circuit 23 extracts negative γ-correction data $NG_B$ arranged in the head portion thereof from the image data signal VDX, and supplies the negative γ-correction data $NG_B$ to the γ register 24. Thus, as shown in FIG. 2, the γ register 22 supplies the γ-correction data $PG_B$ to the γ characteristic regulation circuit SX of the reference gradation voltage generation circuit 32 as γ-correction data SP, while writing over the previous data and holding the γ-correction data $PG_B$. Also, as shown in FIG. 2, the γ register 24 supplies the γ-correction data $NG_B$ to the γ characteristic regulation circuit SX of the reference gradation voltage generation circuit 33 as γ-correction data SN, while writing over the previous data and holding the γ-correction data $NG_B$.

Thus, the reference gradation voltage generation circuit 32 generates reference gradation voltages Y1 to Y256 having a γ characteristic based on the γ-correction data $PG_B$, and supplies the reference gradation voltages Y1 to Y256 to the DA conversion circuit 34. The reference gradation voltage generation circuit 33 generates reference gradation voltages X1 to X256 having a γ characteristic based on the γ-correction data $NG_B$, and supplies the reference gradation voltages X1 to X256 to the DA conversion circuit 35. The DA conversion circuit 34 converts display data $Q_1$ to $Q_n$ corresponding to the aforementioned display data series $LD_B$ into analog positive gradation voltages $P_1$ to $P_n$, respectively, on the basis of the reference gradation voltages Y1 to Y256 having the γ characteristic based on the γ-correction data $PG_B$. The DA conversion circuit 35 converts display data $Q_1$ to $Q_n$ corresponding to the aforementioned display data series $LD_B$ into analog negative gradation voltages $N_1$ to $N_n$, respectively, on the basis of the reference gradation voltages X1 to X256 having the γ characteristic based on the γ-correction data $NG_B$.

As described above, in the display device 100, as shown in FIG. 2, the drive control unit 11 supplies the data driver 13 with the image data signal VDX in which the γ-correction data PG and NG, which is used when converting the display data $PD_1$ to $PD_n$ into the positive and negative gradation voltages, are arranged together with the display data $PD_1$ to $PD_n$ of one horizontal display line in each horizontal scan period H. Therefore, in the γ-correction data transmission unit 130 of the data driver 13, the γ registers 22 and 24 are overwritten with the γ-correction data PG and NG included in the image data signal VDX, respectively, in each horizontal scan period. The gradation voltage conversion unit 132 converts the display data $PD_1$ to $PD_n$ of one horizontal display line into the positive gradation voltages $P_1$ to $P_n$ and the negative gradation voltages $N_1$ to $N_n$ with conversion characteristics based on the γ-correction data PG and NG that has been written in the γ registers 22 and 24, respectively. The drive control unit 11 and the data driver 13 of the display device 100 repeatedly perform such a series of processes.

Accordingly, to generate the positive (negative) gradation voltages $P_1$ to $P_n$ ($N_1$ to $N_n$) in the gradation voltage conversion unit 132, as shown in FIG. 5, only one system of the reference gradation voltage generation circuit (33) that includes the amplifiers (AMP1, AMP2, and AP0 to AP6), the ladder resistors (RD0 to RD160 and R0 to R254), and the γ characteristic regulation circuit (SX) is required.

Therefore, according to the configuration as shown in FIGS. 3 to 5, it is possible to reduce the size of the circuit, as compared with the driver of Patent Document 1 in which gradation voltage generation circuits specific to each of red, green, and blue components (i.e. three systems of gradation voltage generation circuits) are provided.

In the aforementioned embodiments, $PG_R$ and $NG_R$ indicate γ-correction data for a red component, $PG_G$ and $NG_G$ indicate γ-correction data for a green component, and $PG_B$ and $NG_B$ indicate γ-correction data for a blue component. The drive control unit 11 may change the contents itself of each of $PG_R$, $NG_R$, $PG_G$, $NG_G$, $PG_B$, and $NG_B$ on a horizontal display line basis. Thus, it is possible to change the setting of the γ characteristic on a horizontal display line (a horizontal scan period) basis.

In the example shown in FIG. 2, the γ-correction data PG and NG corresponding to one of red, green, and blue colors is arranged immediately before the display data series LD of one horizontal display line in each horizontal scan period H of the image data signal VDX, but the γ-correction data PG and NG is not necessarily arranged in every horizontal scan period H.

When there is no vacant time to arrange the γ-correction data PG and NG in each horizontal scan period H of the image data signal VDX, all the γ-correction data PG and NG may be arranged only in the head portion of one vertical scan period.

Figure 6:
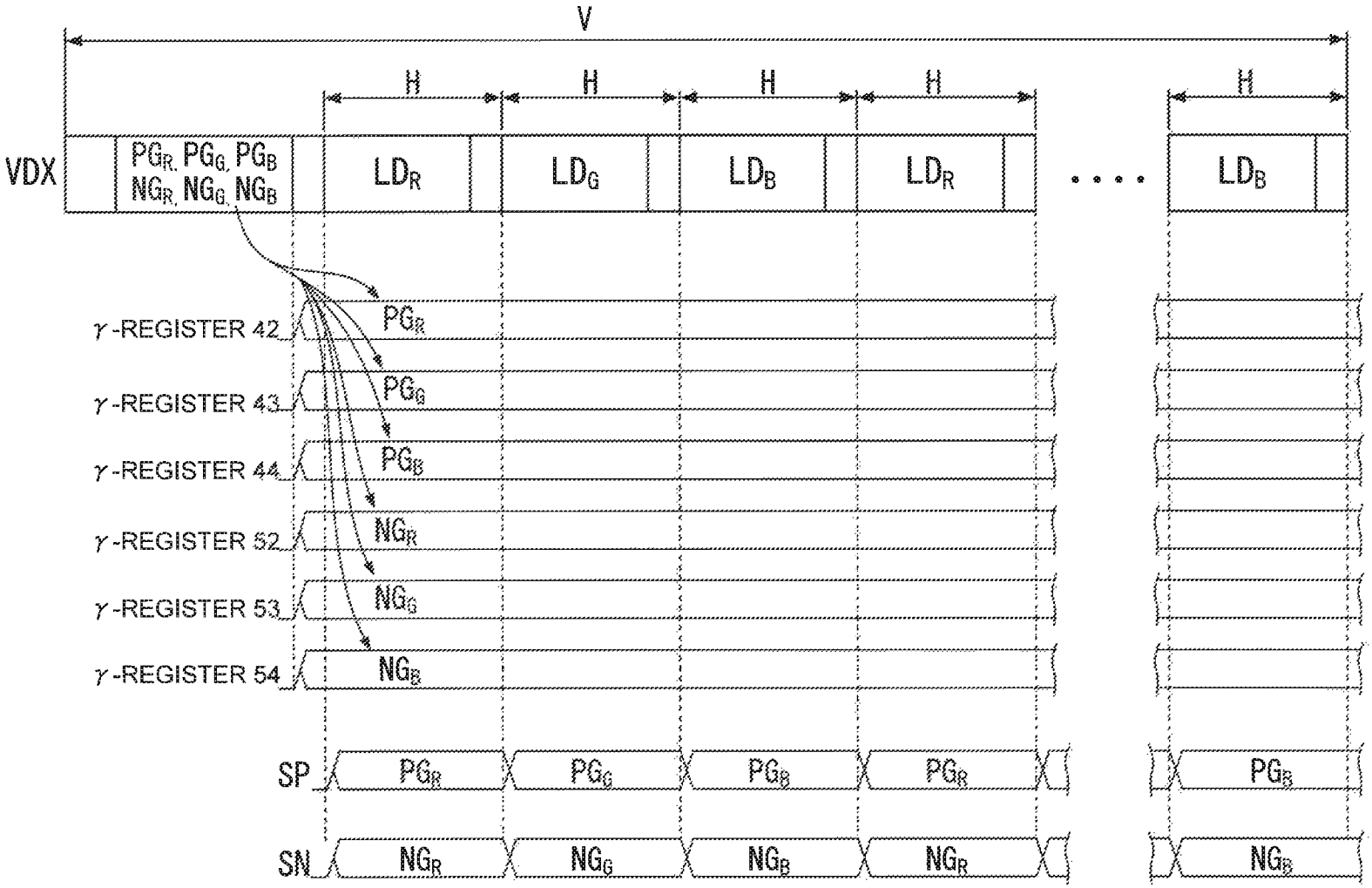
FIG. 6 is a time chart showing another example of the format of the image data signal VDX and the operations of γ registers and selectors included in the reference gradation voltage generation circuit 32 (33)

FIG. 6 is a drawing showing another example of the format of the image data signal VDX generated in consideration of this point. In other words, as shown in FIG. 6, the drive control unit 11 supplies the data driver 13 with the image data signal VDX in which the display data series LD corresponding to one horizontal display line is arranged in each horizontal scan period H and all the γ-correction data $PG_R$, $PG_G$, $PG_B$, $NG_R$, $NG_G$, and $NG_B$ are arranged only in the head portion of one vertical scan period V. In this case, the γ-correction data transmission unit 130 of the data driver 13 has the configuration of FIG. 7, instead of the configuration of FIG. 4.

Figure 7:
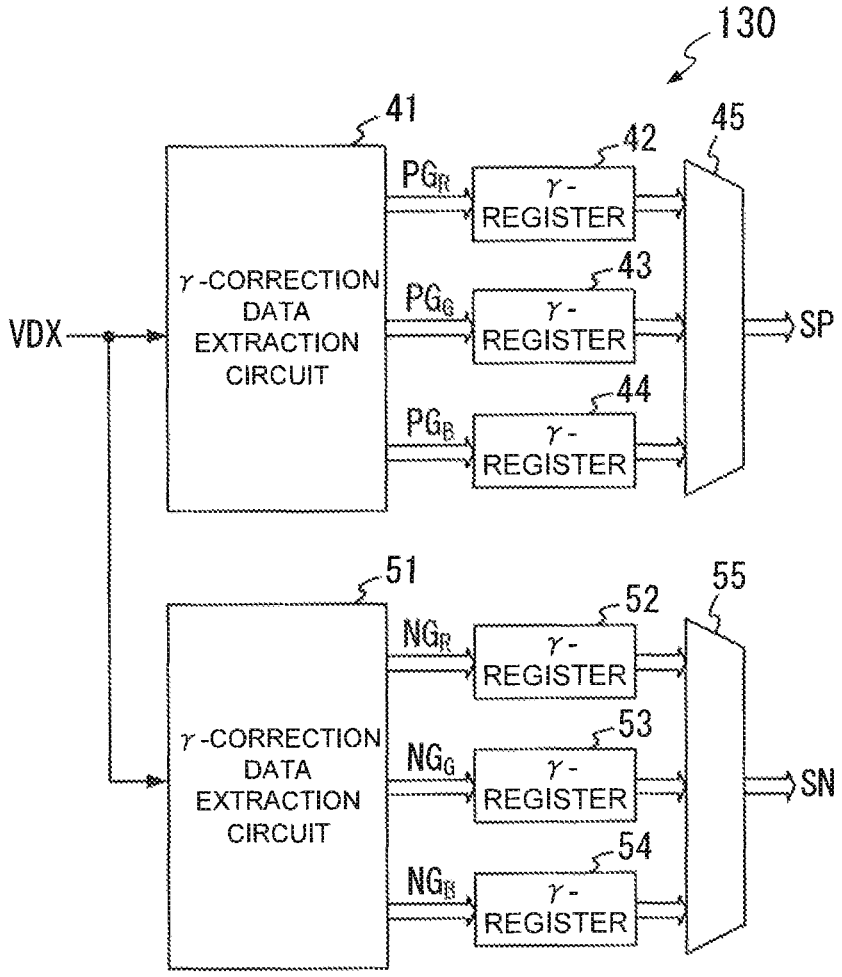
FIG. 7 is a circuit diagram showing another example of the internal configuration of the γ-correction data transmission unit 130.

In FIG. 7, a γ-correction data extraction circuit 41 extracts the positive γ-correction data $PG_R$, $PG_G$, and $PG_B$ arranged in the head portion of the one vertical scan period V in each vertical scan period V of the image data signal VDX. The γ-correction data extraction circuit 41 supplies the extracted γ-correction data $PG_R$ to a γ register 42, supplies the extracted γ-correction data $PG_G$ to a γ register 43, and supplies the extracted γ-correction data $PG_B$ to a γ register 44. The γ register 42 captures the γ-correction data $PG_R$ supplied by the γ-correction data extraction circuit 41, and, as shown in FIG. 6, supplies the γ-correction data $PG_R$ to a selector 45, while holding the γ-correction data $PG_R$ over the one vertical scan period V. The γ register 43 captures the γ-correction data $PG_G$ supplied by the γ-correction data extraction circuit 41, and, as shown in FIG. 6, supplies the γ-correction data $PG_G$ to the selector 45, while holding the γ-correction data $PG_G$ over the one vertical scan period V. The γ register 44 captures the γ-correction data $PG_B$ supplied by the γ-correction data extraction circuit 41, and, as shown in FIG. 6, supplies the γ-correction data $PG_B$ to the selector 45, while holding the γ-correction data $PG_B$ over the one vertical scan period V. The selector 45 sequentially selects the three pieces of γ-correction data $PG_R$, $PG_G$, and $PG_B$ one by one in each horizontal scan period H, and, as shown in FIG. 6, supplies the selected γ-correction data to the γ characteristic regulation circuit SX of the reference gradation voltage generation circuit 32 as γ-correction data SP.

A γ-correction data extraction circuit 51 extracts the negative γ-correction data $NG_R$, $NG_G$, and $NG_B$ arranged in the head portion of the one vertical scan period V in each vertical scan period V of the image data signal VDX. The γ-correction data extraction circuit 51 supplies the extracted γ-correction data $NG_R$ to a γ register 52, supplies the extracted γ-correction data $NG_G$ to a γ register 53, and supplies the extracted γ-correction data $NG_B$ to a γ register 54. The γ register 52 captures the γ-correction data $NG_R$ supplied by the γ-correction data extraction circuit 51, and, as shown in FIG. 6, supplies the γ-correction data $NG_R$ to a selector 55, while holding the γ-correction data $NG_R$ over the one vertical scan period V. The γ register 53 captures the γ-correction data $NG_G$ supplied by the γ-correction data extraction circuit 51, and, as shown in FIG. 6, supplies the γ-correction data $NG_G$ to the selector 55, while holding the γ-correction data $NG_G$ over the one vertical scan period V. The γ register 54 captures the γ-correction data $NG_B$ supplied by the γ-correction data extraction circuit 51, and, as shown in FIG. 6, supplies the γ-correction data $NG_B$ to the selector 55, while holding the γ-correction data $NG_B$ over the one vertical scan period V. The selector 55 sequentially selects the three pieces of γ-correction data $NG_R$, $NG_G$, and $NG_B$ one by one in each horizontal scan period H, and, as shown in FIG. 6, supplies the selected γ-correction data to the γ characteristic regulation circuit SX of the reference gradation voltage generation circuit 33 as γ-correction data SN.

Thus, when the γ-correction data transmission unit 130 has the configuration of FIG. 7, to generate the positive (negative) gradation voltages $P_1$ to $P_n$ ($N_1$ to $N_n$), the selector 45 (55) and the γ register specific to each of red, green, and blue components i.e. three systems of γ registers 42 to 44 (52 to 54) are required.

However, as to the reference gradation voltage generation circuit 32 (33), only one system is required for each polarity, so that it is possible to reduce the size of the circuit, as compared with the driver of Patent Document 1 in which independent three systems of circuits corresponding to three colors of red, green, and blue are required.

In the above-described embodiments, the reference gradation voltage generation circuit 32 (33) is provided with the input amplifiers AMP1 and AMP2 and the first ladder resistor (RD0 to RD160), and a plurality of voltages having different voltage values from each other are supplied to the γ characteristic regulation circuit SX through the respective output taps (a1 to a160) of the first ladder resistor. However, a circuit constituted by the first ladder resistor and the input amplifiers AMP1 and AMP2 may be eliminated, and a voltage group corresponding to the voltages outputted from the plurality of output taps of the circuit may be directly supplied from the outside to the γ characteristic regulation circuit SX.

In the above-described embodiments, the γ-correction data pieces ($PG_R$, $PG_G$, $PG_B$, $NG_R$, $NG_G$, and $NG_B$) are supplied to the data driver 13 in the form of the image data signal VDX, but the γ-correction data may not be included in the image data signal VDX, but may be directly supplied from the outside to the data driver 13. Thus, even when there is insufficient vacant time to arrange the γ-correction data in each horizontal scan period H of the image data signal VDX, the γ-correction data can be rewritten in each horizontal scan period H.

The above-described embodiments describe the configuration and operation of the drive control unit 11 and the data driver 13 by taking a case where the display device 20 is a liquid crystal display panel as an example, but the display device 20 may be, for example, an organic EL (electroluminescence) panel. In this case, the drive control unit 11 supplies the data driver 13 with an image data signal VDX that includes only positive γ-correction data ($PG_R$, $PG_G$, and $PG_B$) as γ-correction data. Furthermore, the organic EL panel eliminates the need for providing the γ-correction data extraction circuit 23 and the γ register 24 included in the γ-correction data transmission unit 130, and eliminates the need for providing the reference gradation voltage generation circuit 33 and the DA conversion circuit 35 included in the gradation voltage conversion unit 132.

In the last analysis, the display driver including the drive control unit 11 and the data driver 13 just needs to include the following gamma correction data transmission unit (130) and gradation voltage conversion unit (32, 34). The gamma correction data transmission unit transmits a plurality of gamma correction data pieces ($PG_R$, $PG_G$, $PG_B$) one by one in each predetermined period (H). The gradation voltage conversion unit converts brightness levels ($Q_1$ to $Q_n$) indicated by a video signal into gradation voltages ($P_1$ to $P_n$), with a gamma characteristic based on the gamma correction data piece transmitted from the gamma correction data transmission unit. The gamma correction data transmission unit just needs to include the following control unit (11), gamma correction data extraction unit (21, 41), and gamma register (22). The control unit generates an image data signal (VDX) in which a plurality of gamma correction data pieces ($PG_R$, $PG_G$, $PG_B$) are arranged one by one in each horizontal scan period, as well as series of display data pieces ($PD_1$ to $PD_n$) indicating the brightness levels of respective display cells ($C_R$, $C_G$, $C_B$) indicated by a video signal (VD) are grouped and arranged on a horizontal scan period basis. The gamma correction data extraction unit sequentially extracts a gamma correction data piece from the image data signal in each horizontal scan period. The gamma register transmits the gamma correction data piece extracted by the gamma correction data extraction unit to the gradation voltage conversion unit, while holding the gamma correction data piece. A gamma correction data transmission unit just needs to include the following control unit (11), gamma correction data extraction unit (41), plurality of gamma registers (42 to 44), and selector (45). The control unit generates an image data signal (VDX) in which a plurality of gamma correction data pieces ($PG_R$, $PG_G$, $PG_B$) are arranged in a head portion of each vertical scan period (V), as well as series of display data pieces ($PD_1$ to $PD_n$) indicating the brightness levels of the respective display cells ($C_R$, $C_G$, $C_B$) indicated by a video signal (VD) are grouped and arranged on a horizontal scan period basis. The gamma correction data extraction unit sequentially extracts a plurality of gamma correction data pieces from the image data signal in each vertical scan period. Then, the plurality of gamma registers each hold the plurality of gamma correction data pieces extracted by the gamma correction data extraction unit. The selector selects the gamma correction data pieces held in the respective gamma registers one by one in each horizontal scan period, and transmits the selected gamma correction data piece to the gradation voltage conversion unit.

This application is based on a Japanese Patent Application No. 2016-116043 which is hereby incorporated by reference.

What is claimed is:

1. A display driver for supplying a display device having a plurality of display cells with gradation voltages corresponding to brightness levels of the respective display cells indicated by a video signal, the display driver comprising:

a gamma correction data transmission circuit that includes:

a gamma correction data extraction circuit that receives an image data signal in which a plurality of gamma correction data pieces representing gamma correction values, for correcting correspondence relation between brightness indicated by the video signal and brightness of color actually displayed on the display device, are arranged in a head portion of each predetermined period, as well as a series of display data pieces indicating the brightness levels of the respective display cells indicated by the video signal are grouped and arranged on the predetermined period basis, the gamma correction data extraction circuit sequentially extracting the gamma correction data piece from the image data signal in the predetermined period; and a gamma register that holds and transmits the gamma correction data piece extracted by the gamma correction data extraction circuit in the predetermined period; and a gradation voltage conversion circuit that generates a plurality of reference gradation voltages with a gamma characteristic based on the gamma correction value indicated by the gamma correction data piece transmitted from the gamma correction data transmission circuit to convert the brightness levels into the gradation voltages according to the reference gradation voltages.

2. The display driver according to claim 1, wherein the predetermined period is a horizontal scan period of the video signal.

3. The display driver according to claim 1, wherein the plurality of gamma correction data pieces are constituted by a first gamma correction data piece indicating a gamma correction value for a red component, a second gamma correction data piece indicating a gamma correction value for a green component, and a third gamma correction data piece indicating a gamma correction value for a blue component.

4. The display driver according to claim 1, wherein horizontal display lines in which the plurality of display cells for red display are arranged, horizontal display lines in which the plurality of display cells for green display are arranged, and horizontal display lines in which the plurality of display cells for blue display are arranged are periodically arranged in the display device.

5. The display driver according to claim 1, further comprising a data capture circuit that receives the image data signal, and that captures the series of display data pieces included in the image data signal in every horizontal scan period, and that supplies the series of display data pieces to the gradation voltage conversion circuit as display data.

6. A display driver for supplying a display device having a plurality of display cells with gradation voltages corresponding to brightness levels of the respective display cells indicated by a video signal, the display driver comprising:

a gamma correction data transmission circuit that includes:

a gamma correction data extraction circuit that receives an image data signal in which a plurality of gamma correction data pieces representing gamma correction values, for correcting correspondence relation between brightness indicated by the video signal and brightness of color actually displayed on the display device, are arranged in a head portion of each vertical scan period, as well as series of display data pieces indicating the brightness levels of the respective display cells indicated by the video signal are grouped and arranged on a horizontal scan period basis, the gamma correction data extraction circuit extracting the plurality of gamma correction data pieces from the image data signal in the vertical scan period;

a plurality of gamma registers each that holds the plurality of gamma correction data pieces extracted by the gamma correction data extraction circuit; and a selector sequentially selecting the gamma correction data pieces held in the plurality of respective gamma registers one by one in each horizontal scan period, and transmitting the selected gamma correction data piece; and a gradation voltage conversion circuit that generates a plurality of reference gradation voltages with a gamma characteristic based on the gamma correction value indicated by the gamma correction data piece transmitted from the gamma correction data transmission circuit to convert the brightness levels into the gradation voltages according to the reference gradation voltages.

7. The display driver according to claim 6, further comprising a data capture circuit that receives the image data signal, and that captures the series of display data pieces included in the image data signal in every horizontal scan period, and that supplies the series of display data pieces to the gradation voltage conversion circuit as display data.

8. A semiconductor device comprising a display driver that is formed therein and supplies a display device having a plurality of display cells with gradation voltages corresponding to brightness levels of the respective display cells indicated by a video signal, the display driver comprising:

a gamma correction data transmission circuit that includes:

a gamma correction data extraction circuit that receives an image data signal in which a plurality of gamma correction data pieces representing gamma correction values, for correcting correspondence relation between brightness indicated by the video signal and brightness of color actually displayed on the display device, are arranged in a head portion of each predetermined period, as well as series of display data pieces indicating the brightness levels of the respective display cells indicated by the video signal are grouped and arranged on the predetermined period basis, the gamma correction data extraction circuit sequentially extracting the gamma correction data piece from the image data signal in the predetermined period; and a gamma register that holds and transmits the gamma correction data piece extracted by the gamma correction data extraction circuit in the predetermined period; and a gradation voltage conversion circuit that generates a plurality of reference gradation voltages with a gamma characteristic based on the gamma correction value indicated by the gamma correction data piece transmitted from the gamma correction data transmission circuit to convert the brightness levels into the gradation voltages according to the reference gradation voltages.

* * * * *